US006766859B2

(12) United States Patent
Haugen et al.

(10) Patent No.: US 6,766,859 B2
(45) Date of Patent: Jul. 27, 2004

(54) WELLBORE LINER SYSTEM

(75) Inventors: David M. Haugen, League City, TX (US); Mark Kuck, Anchorage, AK (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/244,325

(22) Filed: Sep. 16, 2002

(65) Prior Publication Data

US 2003/0075334 A1 Apr. 24, 2003

Related U.S. Application Data

(63) Continuation of application No. 09/587,194, filed on Jun. 5, 2000, now Pat. No. 6,547,006, which is a continuation-in-part of application No. 09/053,254, filed on Apr. 1, 1998, now Pat. No. 6,070,665, which is a continuation-in-part of application No. 08/642,118, filed on May 2, 1996, now Pat. No. 5,806,595.

(51) Int. Cl.[7] ..... E21B 7/06; E21B 43/14

(52) U.S. Cl. ..... 166/313; 166/50; 166/117.6

(58) Field of Search ..... 166/50, 313, 117.6, 166/298; 175/61, 79, 80, 81, 82

(56) References Cited

U.S. PATENT DOCUMENTS

| | | | | |
|---|---|---|---|---|
| 2,014,805 A | | 9/1935 | Hinderliter | 255/1 |
| 2,103,622 A | | 12/1937 | Kinzbach | 255/1 |
| 2,362,529 A | | 11/1944 | Barrett et al. | 255/1.6 |
| 2,658,431 A | | 11/1953 | James | 255/1.6 |
| 2,694,549 A | | 11/1954 | James | 255/1.6 |
| 2,797,893 A | | 7/1957 | McCune et al. | 255/1.6 |
| 2,999,541 A | | 9/1961 | Kinzbach et al. | 166/55.7 |
| 3,397,746 A | | 8/1968 | Liink | 166/117.6 |
| 3,938,853 A | | 2/1976 | Jurgens et al. | 308/4 |
| 4,266,621 A | | 5/1981 | Brock | 175/329 |
| 4,396,075 A | | 8/1983 | Wood et al. | 175/79 |
| 4,610,316 A | | 9/1986 | Boaz | 175/323 |
| 4,699,224 A | | 10/1987 | Burton | 175/61 |
| 4,717,290 A | | 1/1988 | Reynolds et al. | 407/34 |
| 4,796,709 A | | 1/1989 | Lynde et al. | 166/55.6 |
| 4,887,668 A | | 12/1989 | Lynde et al. | 166/55.8 |
| 4,938,291 A | | 7/1990 | Lynde et al. | 166/55.8 |
| 4,978,260 A | | 12/1990 | Lynde et al. | 166/55.6 |
| 4,984,488 A | | 1/1991 | Lunde et al. | 76/115 |
| 5,010,955 A | | 4/1991 | Springer | 166/298 |
| 5,012,877 A | * | 5/1991 | Winters et al. | 175/80 |
| 5,014,778 A | | 5/1991 | Lynde et al. | 166/55.6 |
| 5,038,859 A | | 8/1991 | Lynde et al. | 166/55.6 |

(List continued on next page.)

FOREIGN PATENT DOCUMENTS

| | | | |
|---|---|---|---|
| EP | 0 945 586 A2 | 9/1999 | E21B/7/06 |
| GB | 2 304 764 | 3/1997 | E21B/43/30 |
| WO | 98/09053 | 3/1998 | E21B/33/14 |
| WO | 99/04135 | 1/1999 | E21B/23/00 |
| WO | 01/11185 A1 | 2/2001 | E21B/33/10 |

OTHER PUBLICATIONS

European Search Report, PCT Application No. PCT/GB99/01028, dated Sep. 18, 2003.

*Primary Examiner*—Hoang Dang
(74) *Attorney, Agent, or Firm*—Moser, Patterson & Sheridan, L.L.P.

(57) ABSTRACT

Wellbore apparatus has been invented which, in at least certain aspects, includes a wellbore apparatus having a tubular member with a top end, a bottom end, a hollow portion, and a window therethrough, a sleeve positioned within the hollow portion of the tubular member, the sleeve having a top end and a bottom end, a diverter apparatus within or outside the tubular member and, optionally, below the bottom end of the sleeve, the sleeve movable so that the diverter, and the diverter directs the sleeve to the window and through the window into a bore extending beyond the window, and the window having an edge therearound to which the top end of the sleeve is weldable to sealingly secure the sleeve at the window.

38 Claims, 12 Drawing Sheets

U.S. PATENT DOCUMENTS 5,058,666 A 10/1991 Lynde et al. ..... 166/55.6
5,086,838 A 2/1992 Cassel et al. ..... 166/55.6
5,181,564 A 1/1993 Lindley et al. ..... 166/55.6
5,199,513 A 4/1993 Stewart et al. ..... 175/73
5,253,710 A 10/1993 Carter et al. ..... 166/298
5,289,876 A 3/1994 Graham ..... 166/276
5,297,630 A 3/1994 Lynde et al. ..... 166/297
5,301,760 A 4/1994 Graham ..... 175/61
5,311,936 A 5/1994 McNair et al. ..... 166/50
5,322,127 A 6/1994 McNair et al. ..... 166/313
5,337,808 A 8/1994 Graham ..... 166/191
5,341,873 A 8/1994 Carter et al. ..... 166/117.5
5,353,876 A 10/1994 Curington et al. ..... 166/313
5,373,900 A 12/1994 Lynde et al. ..... 166/297
5,409,060 A 4/1995 Carter ..... 166/237
5,425,417 A 6/1995 Carter ..... 166/117.6
5,427,177 A 6/1995 Jordan et al. ..... 166/50
5,429,187 A 7/1995 Beagrie et al. ..... 166/55.1
5,435,400 A 7/1995 Smith ..... 175/61
5,452,759 A 9/1995 Carter et al. ..... 166/117.6
5,456,312 A 10/1995 Lynde et al. ..... 166/55.6
5,458,209 A 10/1995 Hayes et al. ..... 175/61
5,462,120 A * 10/1995 Gondouin ..... 166/380
5,474,126 A * 12/1995 Lynde et al. ..... 166/117.6
5,477,925 A 12/1995 Trahan et al. ..... 166/382
5,520,252 A * 5/1996 McNair ..... 166/313
5,526,880 A 6/1996 Jordan et al. ..... 166/291
5,551,509 A 9/1996 Braddick ..... 166/55.7
5,564,503 A * 10/1996 Longbottom et al. ..... 166/313
5,651,415 A 7/1997 Scales ..... 166/250.09
5,655,614 A 8/1997 Azar ..... 175/404
5,657,820 A 8/1997 Bailey et al. ..... 166/55.7
5,678,634 A 10/1997 Rehbock et al. ..... 166/377
5,680,901 A 10/1997 Gardes ..... 166/313
5,697,438 A 12/1997 Rehbock et al. ..... 166/55.7
5,697,445 A 12/1997 Graham ..... 166/313
5,715,891 A 2/1998 Graham ..... 166/313
5,727,629 A 3/1998 Blizzard, Jr. et al. ..... 166/298
5,730,221 A 3/1998 Longbottom et al. ..... 166/298
5,730,224 A 3/1998 Williamson et al. ..... 166/386
5,732,773 A 3/1998 Parks et al. ..... 166/117.5
5,735,350 A 4/1998 Longbottom et al. ..... 166/313
5,787,987 A * 8/1998 Forsyth et al. ..... 166/313
5,806,596 A 9/1998 Hardy et al. ..... 166/298
5,806,614 A 9/1998 Nelson ..... 175/61
5,813,465 A 9/1998 Terrell et al. ..... 166/298
5,829,518 A 11/1998 Gano et al. ..... 166/55.7
5,832,997 A 11/1998 White et al. ..... 166/117.6
5,833,003 A 11/1998 Longbottom et al. ..... 166/298
5,842,528 A 12/1998 Johnson et al. ..... 175/45
5,845,707 A 12/1998 Longbottom ..... 166/50
5,845,710 A 12/1998 Longbottom et al. ..... 166/313
5,845,722 A 12/1998 Makohl et al. ..... 175/101
5,853,049 A 12/1998 Keller ..... 166/380
5,988,272 A 11/1999 Bruce ..... 166/55.6
6,012,516 A * 1/2000 Brunet ..... 166/50
6,015,012 A * 1/2000 Reddick ..... 166/313
6,070,665 A * 6/2000 Singleton et al. ..... 166/298
6,073,697 A * 6/2000 Parlin et al. ..... 166/313
6,079,488 A * 6/2000 Begg et al. ..... 166/50
6,209,644 B1 * 4/2001 Brunet ..... 166/297
6,244,340 B1 * 6/2001 McGlothen et al. ..... 166/255.3

* cited by examiner

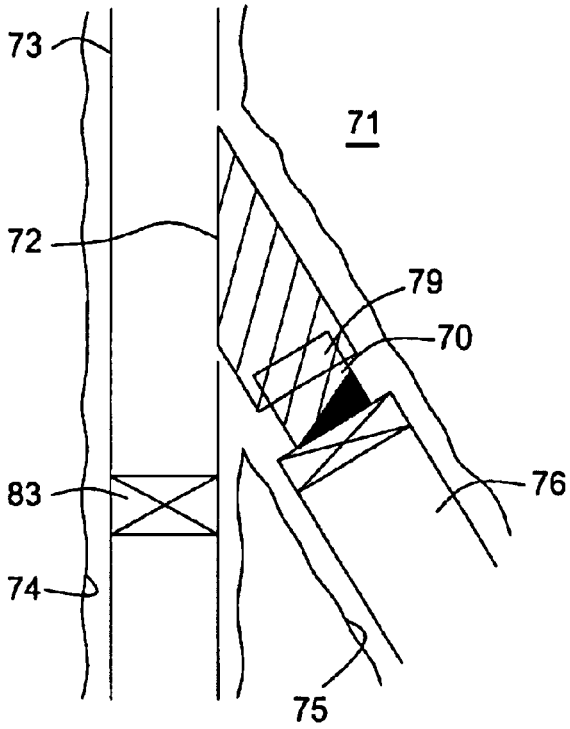
FIG. 5A
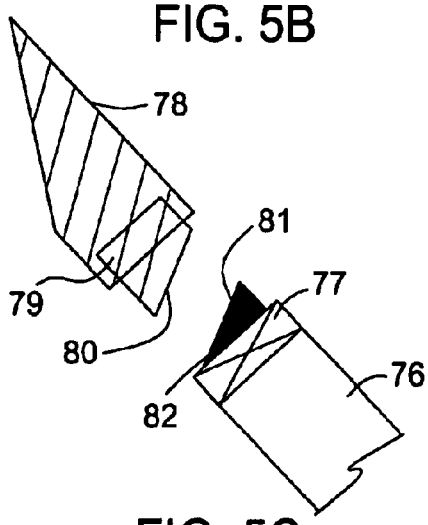
FIG. 5B
FIG. 5C
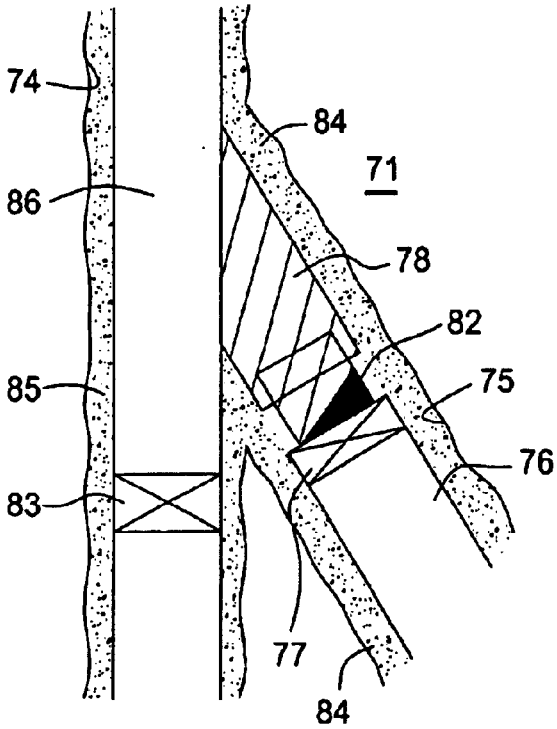
FIG. 6
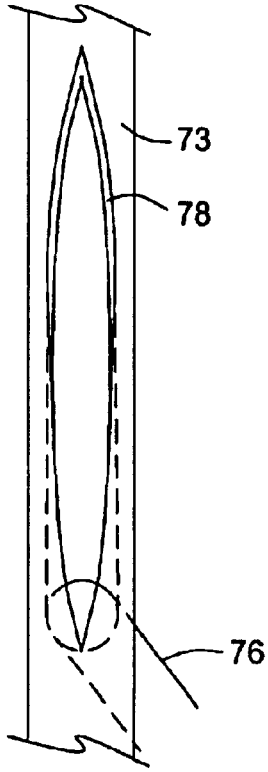
FIG. 7

WELLBORE LINER SYSTEM

CROSS-REFERENCE TO RELATED APPLICATIONS

This is a continuation of U.S. application Ser. No. 09/587,194, filed on Jun. 5, 2000, now U.S. Pat. No. 6,547,006, which is incorporated by reference herein. U.S. application Ser. No. 09/587,194 is a continuation-in-part of U.S. application Ser. No. 09/053,254, filed on Apr. 1, 1998, U.S. Pat. No. 6,070,665, which is incorporated by reference herein. U.S. application Ser. No. 09/053,254 is a continuation-in-part of U.S. application Ser. No. 08/642,118, filed on May 2, 1996, U.S. Pat. No. 5,806,595, which is incorporated by reference herein.

BACKGROUND OF THE INVENTION

1. Field of the Invention

This invention is directed to wellbore milling systems and methods; and, in one particular aspect, to such systems and methods for milling through a liner that projects into a lateral wellbore from a main wellbore to re-establish a pathway to the main wellbore.

2. Description of the Related Art

The prior art discloses a wide variety of wellbore milling systems and methods and a wide variety of systems and methods for re-establishing a pathway through a main wellbore after lining a lateral wellbore with a liner. Many such prior art systems and methods require a guide for a milling system so that the milling system mills back through the liner rather than entering the liner itself and milling in the wrong location. Without such a guide a lateral liner can be damaged by the wrongly located milling system, and the pathway through the main wellbore will not be re-established.

SUMMARY OF THE INVENTION

The present invention, in one aspect, discloses a milling system for milling through a lateral bore liner to re-establish a main wellbore. In one aspect the milling system includes a mill with milling blades dressed with milling matrix material and milling inserts; a tubular string connected to and above the mill; and at least one centralizer, rotating centralizer, stabilizer, rotating stabilizer, coupling bushing or the like through which the tubular string extends, the at least one coupling bushing disposed in the main wellbore above a casing window through which the lateral liner extends into the lateral bore.

In one aspect such a system has a plurality of spaced-apart coupling bushings disposed above the lateral bore which serve to position the milling system and prevent it from entering the lateral liner. Such coupling-bushing will facilitate directing of the milling system in the direction of the main wellbore so that the milling system mills through the liner in the direction of the main wellbore, thereby reestablishing the main wellbore. In one aspect one of the coupling bushings is placed above, and in one aspect near the top of, the window at the beginning of the lateral bore.

In some systems a lateral bore liner is supported by an external casing packer, liner hanger, pack-off liner hanger, or similar support positioned in a main wellbore. A milling system as, described above that is introduced into the liner through the main wellbore should not abut or hang up on the top of the support apparatus. To facilitate movement of such a milling system past and through an external casing packer a centering apparatus is releasably connected at the bottom of the milling system. As the milling system approaches the top of the external casing packer, the centering device contacts the top of the external casing packer with the lower end of the milling system centered over the bore into the liner. Further downward force on the string to which the milling system is attached releases the centering device and the milling system enters the liner.

In one aspect of a milling system as described herein a coupling bushing has inner slots from top to bottom and/or external ribs to promote fluid flow through and/or around the coupling bushing. Thus circulation for mill cooling and/or cuttings and debris removal is possible.

In one aspect entry of a liner into a lateral wellbore is facilitated by using a bent sub or a bent member at the end of the liner. Also, an orienting apparatus may be used at the end of the liner.

The present invention also discloses systems and methods for shrouding a main bore/lateral liner interface in areas in which formation may be exposed or unsupported.

The present invention discloses systems and methods for installing a liner in a lateral wellbore, the liner having a preformed window located so that, upon desired emplacement of the liner, the preformed window is located above a main wellbore from which the lateral wellbore extends. In this way the preformed window, in one aspect, is positioned over a diverter or whipstock used to direct the liner into the lateral wellbore. Thus a mill is insertable and movable to and through the preformed window to mill through the diverter or whipstock, re-establishing the main wellbore.

It is, therefore, an object of at least certain preferred embodiments of the present invention to provide:

- New, useful, unique, efficient, nonobvious devices and methods for milling through a lateral bore liner to re-establish a main wellbore;
- Such systems and methods in which one or more coupling bushings, centralizers, stabilizers, and/or similar items are used on a string to which the milling system is connected to position the milling system and inhibit its undesired entry into a lateral liner; and
- Such systems and methods with a centering device releasably connected to the milling system for facilitating its entry into a top opening of a liner in the main wellbore.

It is, therefore, an object of at least certain preferred embodiments of the present invention to provide:

New, useful, unique, efficient, nonobvious systems and methods for shrouding a main wellbore/lateral wellbore interface and excluding formation from entering therein.

It is, therefore, an object of at least certain preferred embodiments of the present invention to provide:

New, useful, unique, efficient, nonobvious systems and methods in which a liner having a preformed window is installed with part of the liner in a lateral wellbore and the preformed window located in a main wellbore from which the lateral wellbore extends.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 5A, 5B, and 5C are side cross-section views of a lateral shroud system according to the present invention.

FIG. 6 is a side cross-section view of a lateral shroud system according to the present invention.

FIG. 7 is a front view of a lateral shroud system according to the present invention.

FIG. 16E shows a sleeve of the system of FIG. 16A installed in a wellbore.

DETAILED DESCRIPTION OF THE PREFERRED EMBODIMENT

Figure 1A:
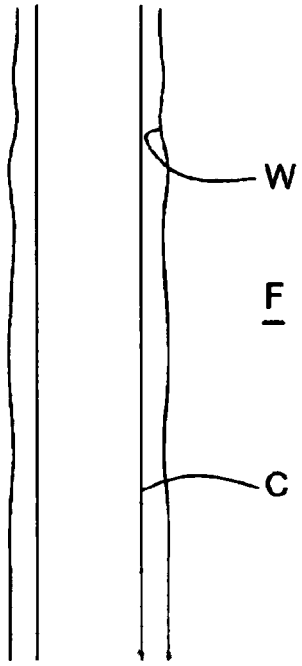
FIG. 1A (PRIOR ART)
FIG. 1A shows in a side cross-section view a prior art wellbore extending down from an earth surface into the earth.

Referring now to FIG. 1A, a main wellbore W extends down into an earth formation F and is cased with a string of casing C. Such wellbores and the drilling of them are old and well-known, as are the systems, tubulars, and methods for casing them.

Figure 1B:
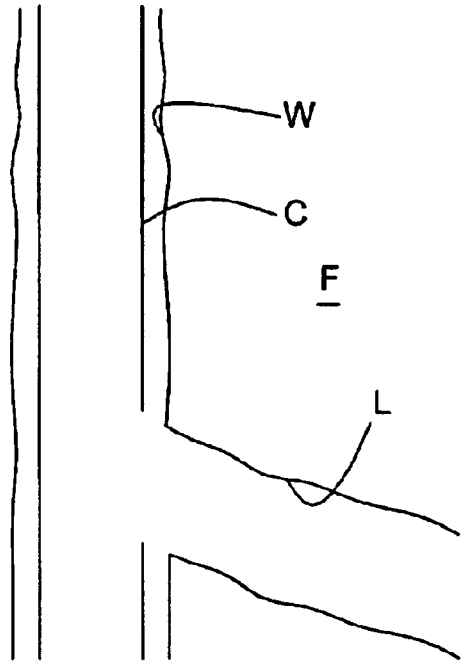
FIG. 1B (PRIOR ART)
FIG. 1B shows in side cross-section view of a lateral wellbore extending from the wellbore of FIG. 1A.

FIG. 1B shows the results of well-known window milling methods that have created a window D and well-known drilling methods that have produced a lateral bore L.

Figure 1C:
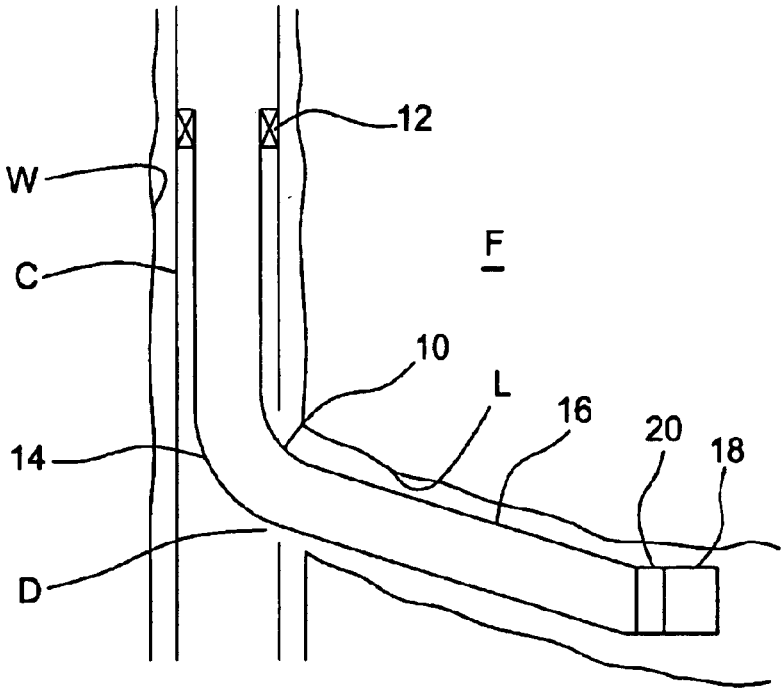
FIG. 1C is a side cross-section view of a liner according to the present invention with a part installed in the lateral wellbore of FIG. 1B.

FIG. 1C shows a liner assembly 10 according to the present invention installed in part of the main wellbore W and part extending into the lateral bore L. It is within the scope of this invention for the part of the liner assembly 10 to extend to any desired length into the lateral bore L, including substantially all of the length of the lateral bore L.

A suitable support 12 holds the liner assembly 10 in place. In one aspect, the support 12 is an external casing packer, but it is within the scope of this invention for it to be a liner hanger, tubing hanger, pack off or any support that supports the liner assembly 10. In another aspect, a non-sealing support or supports may be used if no sealing between the exterior of the liner assembly 10 and the casing interior is desired.

A tubular liner 14 may be made from any suitable material such as metal (steel, aluminum, zinc, alloys thereof), composite, fiberglass, or plastic. Preferably, the tubular liner 14 is bendable sufficiently for a lower portion 16 to bend and enter into the lateral bore L. In one aspect a bent tubular or bent sub 18 is connected at the end of the lower portion 16 of tubular liner 14 to facilitate initial entry of the tubular liner 14 into the lateral bore L. Optional seals (not shown) seal the annular space between a casing C and tubular liner 14. Optionally, an orienting apparatus 20 (including but not limited to a measurement-while-drilling device) may be used connected to the tubular liner 14 for correcting positioning and orienting of the bent sub 18 and of the tubular liner 14.

Figure 1F:
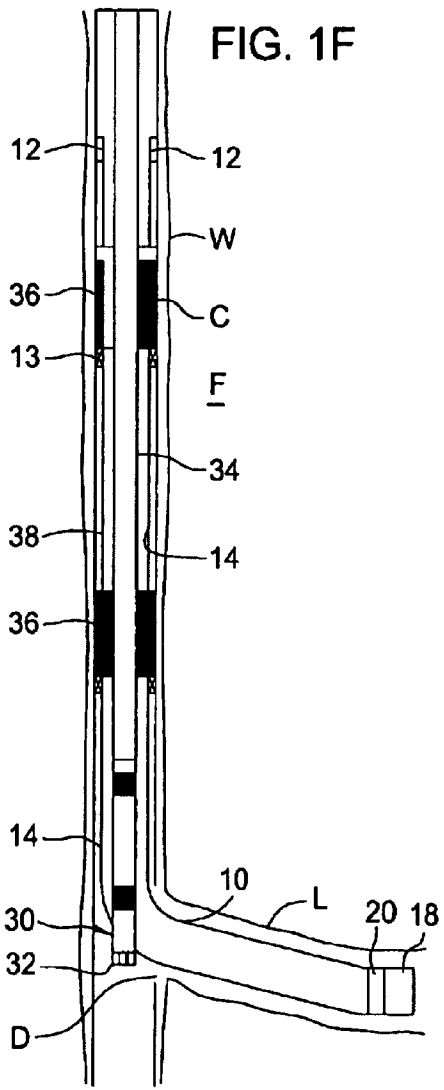
FIGS. 1D–1F are side cross-section views of the wellbore and lateral wellbore of FIG. 1C showing steps of a milling operation with a milling system according to the present invention.
Figure 1E:
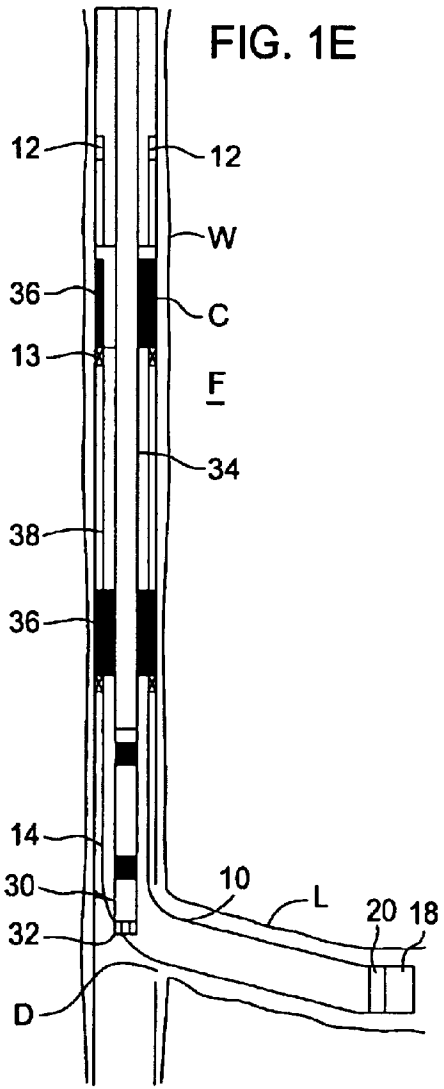
Figure 1D:
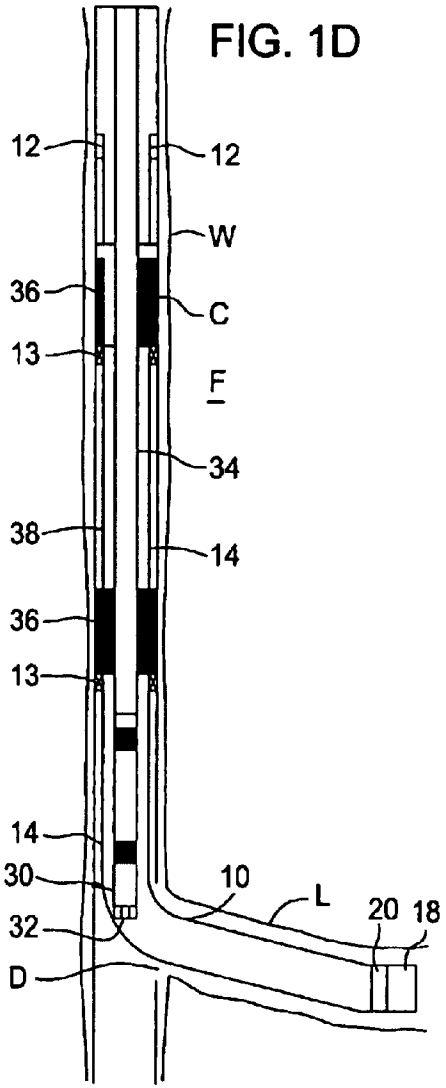
Figure 3A:
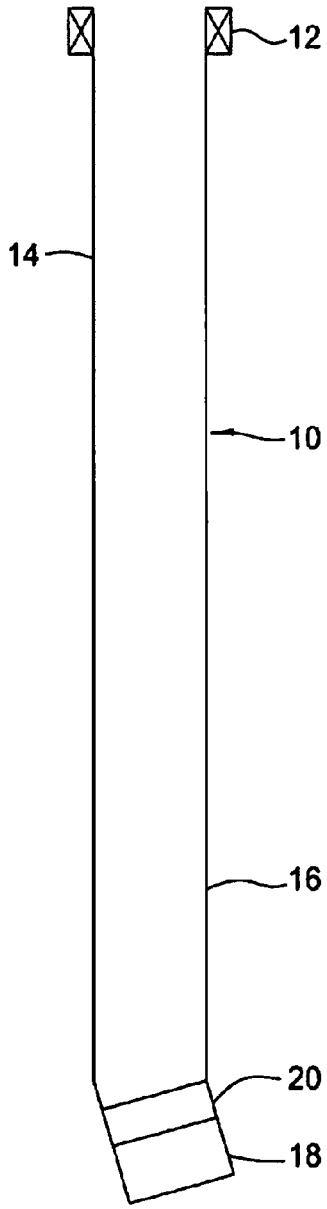
FIG. 3A is a side cross-section view of a liner assembly according to the present invention.
Figure 3B:
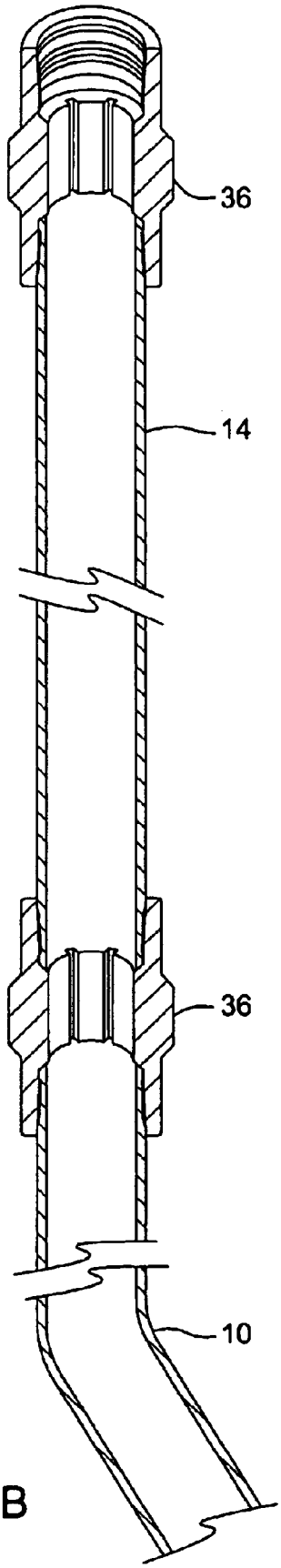
FIG. 3B is a side cross-section view of a casing-coupling system according to the present invention.

FIGS. 1D–1F illustrate use of a milling system 30 to re-establish a pathway through the main wellbore W after installation of the liner assembly 10 as shown in FIG. 1C. The milling assembly 30 has a mill 32 connected to a tubular string 34 (e.g. a string of drill pipe, spiral drill collars that facilitate fluid circulation, or tubing) that extends to and is rotatable from the earth surface. The wellbore W is cased with casing 38. The tubular string 34 extends movably through one or more (two shown) coupling bushings 36 (which connect together tubulars 14) (see also FIG. 3B). In one aspect a spiral grooved drill collar which facilitates fluid circulation and milled cuttings removal is used between the bushings and/or thereabove; in one aspect, for thirty feet above the mill. Alternatively, a third coupling bushing and/or a fourth may be used between the two coupling bushings shown in FIGS. 1D and 3B. Optionally, a liner hanger may be connected on the top of the top coupling bushing shown in FIG. 3B (in one aspect interconnected via a pup joint) to hold the tubular 14.

The milling system 30 and the tubular string 34 are movable through the tubular liner 14 and through the coupling bushings 36 so that longitudinal (up/down) movement of the milling system 30 is possible. The milling system 30 is also rotated as the tubular string is lowered so that the mill 32 contacts and begins to mill at an interior location on the tubular liner 14. In one aspect the mill 32 simply makes a ledge (in a single trip, preferably) (as in FIG. 1E) in the tubular liner 34 that serves as a starting point for additional milling by another mill or mill system (not shown) that is introduced into the main wellbore W following retrieval of the milling system 30. As shown in FIG. 1F, the milling system 30 may be used to mill through the tubular liner 34, re-establishing the main wellbore W and/or creating a pilot hole which provides the location for further milling by another mill or mill system.

Figure 2A:
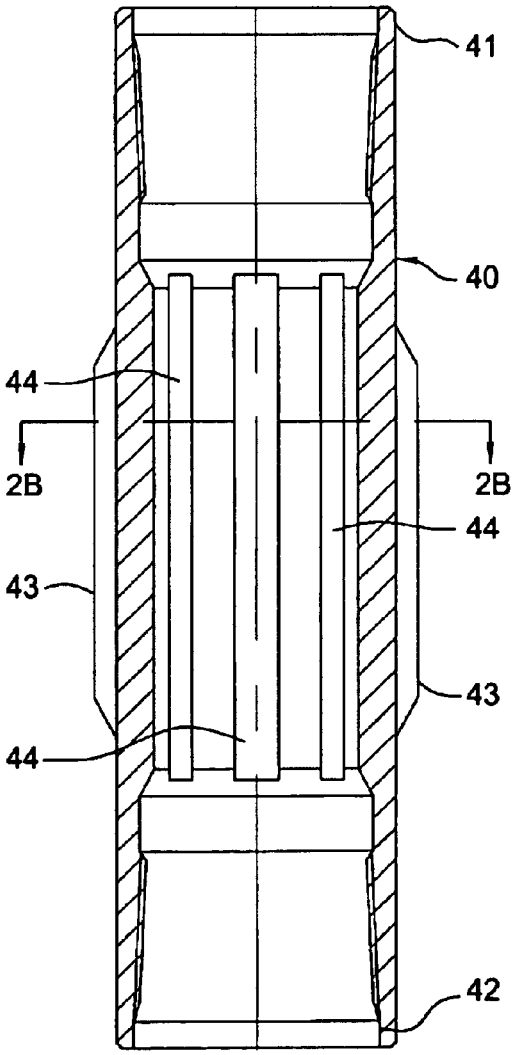
FIG. 2A is a side cross-section view of a generally cylindrical coupling-bushing according to the present invention.
Figure 2B:
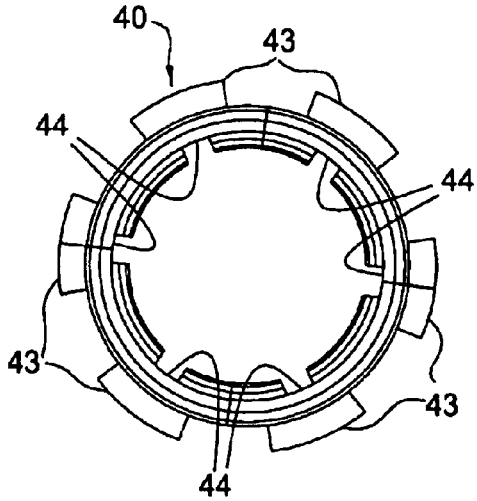
FIG. 2B is a cross-section view along line 2B—2B of FIG. 2A.
Figure 2C:
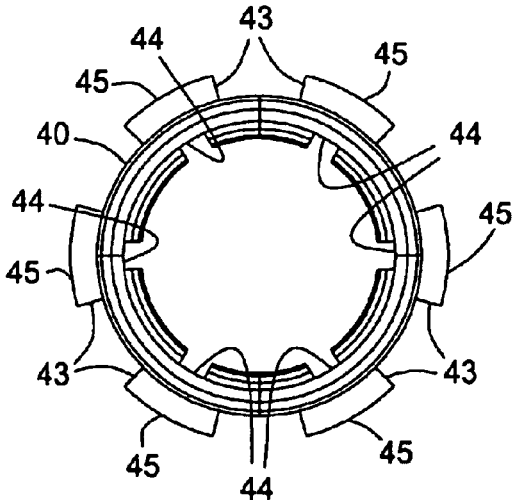
FIG. 2C shows the coupling bushing as in FIG. 2B with tungsten carbide ground smooth on exterior rib surfaces.

FIGS. 2A–2C show a coupling bushing 40 usable as a coupling bushing 36 in the milling system 30. The coupling bushing 40 has internally threaded ends 41 and 42 and a series of exterior ribs 43 between which fluid can flow past the exterior of the coupling bushing 40. A series of internal slots 44 provide an internal fluid flow path through the coupling bushing 40. As desired hardfacing or tungsten carbide material 45 may be applied to outer surfaces of the ribs 43.

Figure 4A:
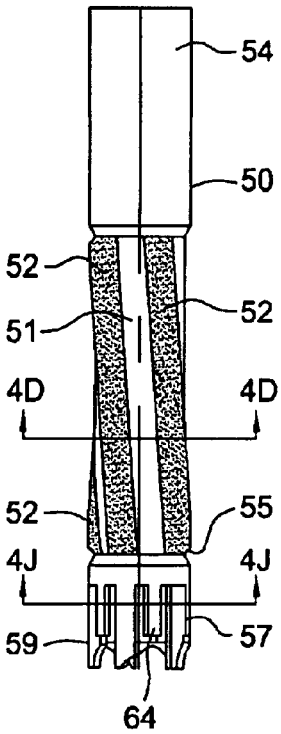
FIG. 4A is a side view of a mill according to the present invention with undressed blades.
Figure 4F:
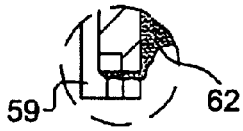
FIG. 4F shows an enlarged portion of the mill end shown in FIG. 4E.
Figure 4E:
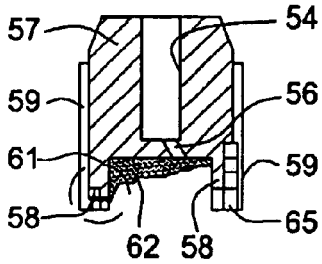
FIG. 4E is a cross-section view of the lower end of the mill of FIG. 4A.
Figure 4D:
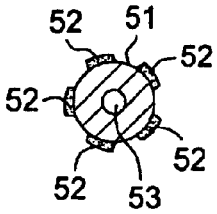
FIG. 4D is a cross-section view along line 4D—4D of FIG. 4A.
Figure 4H:
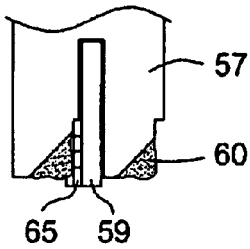
FIGS. 4H–4I show side view of details of the lower end of the mill of FIG. 4A.
Figure 4C:
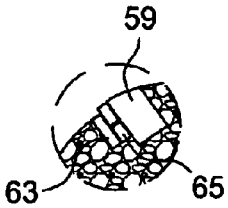
FIG. 4C shows an enlargement of part of the mill as shown in FIG. 4B.
Figure 4I:
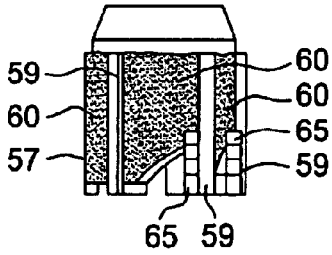
Figure 4B:
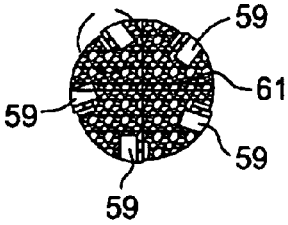
FIG. 4B is a bottom end view of the mill of FIG. 4A.
Figure 4G:
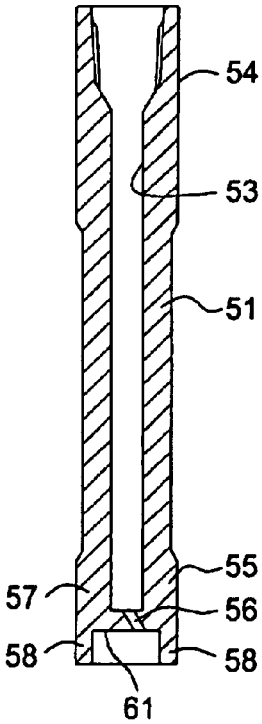
FIG. 4G is a side cross-section view of the mill of FIG. 4A.
Figure 4J:
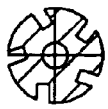
FIG. 4J is a cross-section view along line 4J—4J of FIG. 4A.

FIGS. 4A–4J illustrate a mill 50 usable as the mill 32 of the milling system 30. The mill 50 has a body 51 with milling matrix material 52 (and/or blades with milling inserts, not shown) applied spirally to the body 51 by known techniques. The material 52 may rough (e.g. as applied) or ground smooth. As shown in FIG. 4G, a fluid flow bore 53 extends from a top 54 of the body 51 to a bottom 55 where it communicates with an exit port 56 through the bottom 55 of the body 51. Alternatively, additional exit ports may be provided.

The lower end of the mill 50 has a ribbed member 57 with a series of downwardly projecting lower portions 58 alternating with and spaced apart from a series of blades 59. Matrix milling material 60 is placed between the blades 59 (covering mid portions 64) and over a lower end 61 of the body 51. In one aspect, as shown in FIG. 4E, the matrix milling material is deposited with a ramp portion 62 to facilitate, enhance, and maintain liner engagement and/or to inhibit or prevent coring of the mill. Preferably a space 63 is left between a blade surface (or surfaces of inserts 65) and the milling matrix material 60 to provide a fluid flow course therethrough. Milling inserts 65 as desired may be applied to the blades 59. In one aspect the inserts project beyond milling matrix material.

In one aspect the coupling bushings 36 are spaced-apart about ten feet and the tubular string 34 has an outer diameter of about 4⅛ inches. In one aspect the coupling bushing's inner diameter is chosen so that the tubular string 34 fits tightly within, yet is rotatable within, the coupling bushings 36. In one aspect, known spiral drill pipe and/or spiral drill collars (e.g. one or more) are used adjacent and/or above the mill 32.

In one aspect the tubular liner 14 is positioned so that a lowermost coupling bushing is near the top of the window (in one aspect between two and three feet above it). In one aspect the tubular liner is installed, e.g. as in FIG. 1D, and a portion of the tubular liner above the window is removed (e.g. by milling or with an internal cutter) creating a stub end in the wellbore. A coupling bushing or suitable centralizer or stabilizer is emplaced on the stub end and then the milling system is run into the wellbore, through the newly-emplaced coupling bushing, and into the tubular liner.

Spiraled grooves may be provided in the outer surface of the coupling bushings.

FIG. 5A shows a shroud system 70 for excluding earth formation 71 from an interface at a window 72 in a wellbore casing 73 between a main bore 74 and a lateral bore 75. A liner 76 has been emplaced in the lateral bore 75 and a top 77 thereof does not extend upwardly to the window 72. To prevent earth from the formation 71 from falling into the liner or the main wellbore (through the window 72), a hollow shroud 78 with a plug 79 at a bottom thereof having a ramped end 80 is inserted into the lateral bore 75 so that the ramped end 80 (see FIG. 5B) matingly abuts a corresponding ramped end 81 of a plug 82 in a top end of the liner 76 (see FIG. 5C). Optionally a plug 83 seals off the main bore 74.

In one aspect in the shroud system 70 of FIG. 5A, the liner 76 is run into the lateral bore and cut at a length as shown in FIG. 5A. Then the plug 82 is installed in the liner 76 and the shroud 78 is moved down into the lateral bore 75. If necessary, the shroud 78 is rotated so the ramp 80 seats correctly against the ramp 81. The liner may be installed with the plug 82 in place. The plug 79 can be used with an orientation/location apparatus to insure correct positioning of the shroud 78 for entry into the lateral bore 75. Cement 84 may be installed around the shroud 78 and the liner 76. Cement 85 may be installed around the casing 73 (before or after lateral bore creation or lateral bore cementing.)

In one aspect in the shroud system 70 of FIG. 5A, the liner 76 is run into the lateral bore and cut at a length as shown in FIG. 5A. Then the plug 82 is installed in the liner 76 and the shroud 78 is moved down into the lateral bore 75. If necessary, the shroud 78 is rotated so the ramp 80 seats correctly against the ramp 81. The liner can be installed with the plug 82 in place. The plug 83 can be used with an orientation/location apparatus to insure correct positioning of the shroud 78 for entry into the lateral bore 75. Cement 84 may be installed around the shroud 78 and the liner 76. Cement 85 may be installed around the casing 73 (before or after lateral bore creation or lateral bore cementing.)

In certain aspects, the shroud 78 is made of metal (e.g. steel, zinc, bronze, and any alloys thereof), fiberglass, plastic, or composite. The shroud 78 may be solid or hollow, as may be the plugs 79 and 82.

Optionally, following shroud installation, the area in the main bore 74 adjacent the window 72 and some area above and below the window 72 is cemented with cement 86. If the shroud 78 is hollow, it is also cemented interiorly. Then, to regain access to the lateral bore 75, the cement 86 above and in the window 72 is removed or drilled out, as well as cement within the shroud 78 and the plugs 80 and 82. If the shroud 78 is solid, it is drilled through. If it is desired to re-establish flow through the main bore 74 below the window 72, the cement 86 above, adjacent and below the window 72 is removed or drilled through, as well as the plug 83. The plugs 80 and 82 may be solid or hollow.

In an alternative shroud system, rather than a plug on the lower end of the shroud entering a liner, a ring on the lower end of the shroud is positioned over the liner top and sealingly encompasses it.

Figure 8:
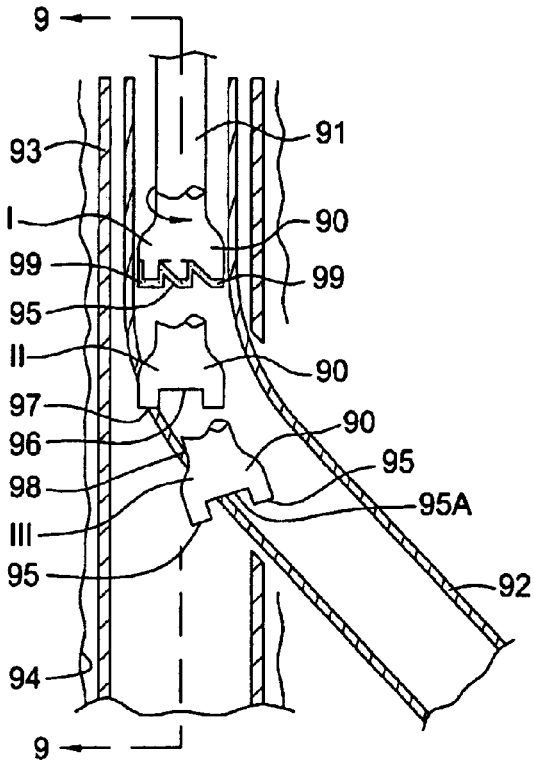
FIG. 8 shows schematically in a side cross-section view a milling operation according to the present invention.
Figure 9:
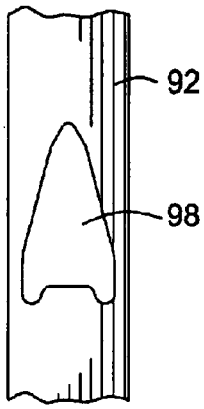
FIG. 9 is a side cross-section view along line 9—9 of FIG. 8 of an opening made with the mill of FIG. 8.

FIG. 8 shows a mill 90 (e.g. usable in the milling system 30, FIG. 1D, as the mill 32) connected to a tubular string 91 (like the string 34, FIG. 1D) in a liner 92 in a casing 93 in a wellbore 94. The mill 90 has downwardly projecting skirt 95 which defines a void area 96. The skirt 95 is dressed with tungsten carbide inserts 99 (e.g. but not limited to those disclosed in U.S. Pat. No. 5,626,189 and pending U.S. application Ser. No. 08/846,092 filed May 1, 1997 both co-owned with the present invention and incorporated fully herein for all purposes). Roman numerals I, II, III show three different positions of the mill 90. In position I the mill 90 has not yet contacted the liner 92. In position II, the mill 90 has milled an initial ledge 97 in the liner 92. In the position II, the mill 90 has milled an opening 98 in the liner 92 (also shown in FIG. 9). In position II, in one aspect, a lower coupling bushing (e.g. as in FIG. 1D or 3B) close to the mill by its contact with the string 91 inhibits the mill's tendency to deflect away from the liner 92 (i.e. to the right in FIG. 8). In position III, the lower portions 95 of the mill 90 inhibit the mill from stepping off the ledge 97 and from re-entering the liner 92. The lower portions 95 facilitate movement of the mill 90 down the curve of the liner 92. A ramp portion 95*a* inhibits or prevents coring of the mill.

Figure 10:
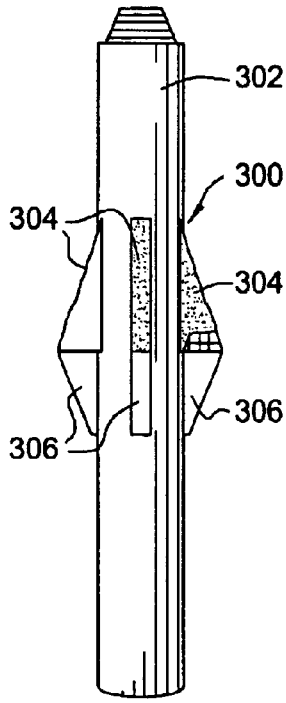
FIG. 10 is a side view of a mill according to the present invention.

FIG. 10 shows a mill 300 according to the present invention with a body 302 and a plurality of blades 304. Associated with each blade 304 is a taper member 306 which is secured to the body 302, or to the blade 304, or to both, either with an adhesive such as epoxy, with connectors such as screws, bolts, or Velcro$^{TH}$ straps or pieces, or by a mating fit of parts such as tongue-and-groove. The taper members may be made of any suitable wood, plastic, composite, foam, metal, ceramic or cermet. In certain embodiments the taper members are affixed to the mill so that upon contact of the lower point of the mill blades with the casing to be milled, the taper members break away so that milling is not impeded.

Figure 11:
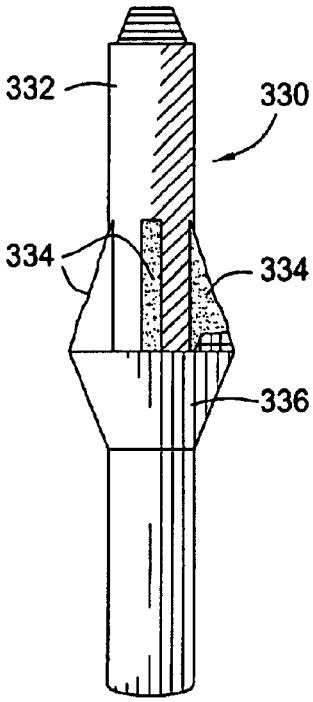
FIG. 11 is a side view of a mill according to the present invention.

FIG. 11 shows a mill 330 according to the present invention with a body 332 and a plurality of blades 334. A taper device 336 is secured around the mill 330 or formed integrally thereon. The taper device 336 extends around the entire circumference of the mill 330 beneath the blades 334 and facilitates movement of the mill 330 through tubulars. The taper device 336 may be a two-piece snap-on or bolt-on device and may be made of the same material as the taper member 306.

Figure 12:
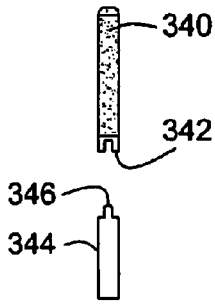
FIG. 12 is a side view of a blade with a taper member according to the present invention.

FIG. 12 shows a blade-taper member combination with a blade 340 having a groove 342 and a taper member 344 with a tongue 346. The tongue 346 is received in the groove 342 to facilitate securement of the taper member 344 to the blade 340. Optionally, an epoxy or other adhesive may be used to glue the taper member to the blade, to a mill body, or to both. The tongue and groove may be dovetail shaped.

Figure 13:
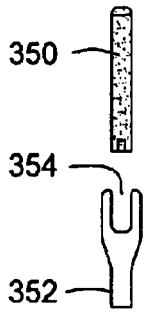
FIG. 13 is a side view of a blade with a taper member according to the present invention.

FIG. 13 shows a blade-taper member combination with a blade 350 and a taper member 352 with a recess 354. The blade 350 is received in and held in the recess 354. Optionally an adhesive may be used to enhance securement of the taper member 352 to the blade, to the mill, or to both.

Figure 14A:
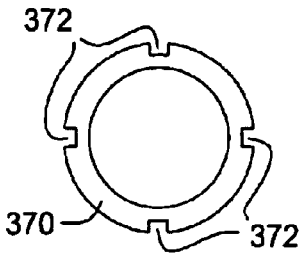
FIG. 14A is a bottom view of a mill body according to the present invention.

FIG. 14A shows a mill body 370 like the bodies of the mills shown in FIGS. 5A, 10, and 11, but with a series of grooves 372 therein which extend longitudinally on the mill body and are sized, configured, and disposed to receive and hold a taper member as shown in FIG. 10, FIG. 12, or FIG. 13. Such a mill body may be used instead of or in combination with any previously-described taper securement means.

Figure 14B:
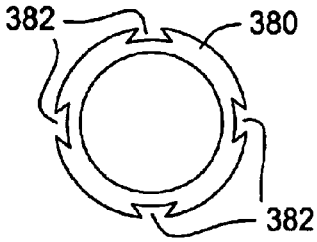
FIG. 14B is a bottom view of a mill body according to the present invention.

FIG. 14B shows a mill body 380 like the bodies of the mills shown in FIGS. 5A, 10, and 11, but with a series of dovetail grooves 382 therein which extend longitudinally on the mill body and are sized, configured, and disposed to receive and hold a taper member as shown in FIG. 10, FIG. 12, or FIG. 13. Such a mill body may be used instead of or in combination with any previously-described taper securement means.

Figure 15A:
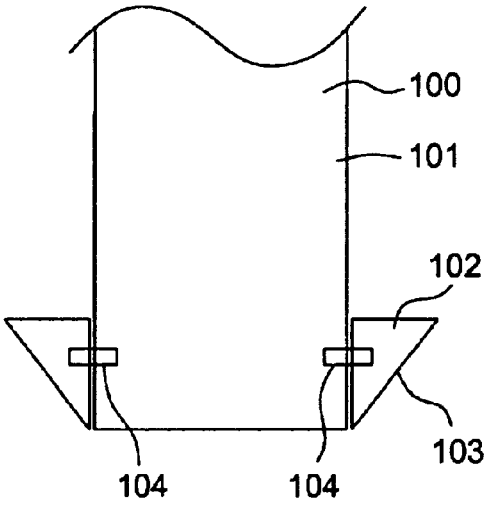
FIGS. 15A–15D are side cross-section views of mills according to the present invention.

FIG. 15A shows a mill 100 usable as the mill in any system described herein which has a cylindrical mill body 101 to which is releasably secured a circular ring 102 that tapers from top to bottom with a taper 103. Shearable pins or bolts 104 releasably hold the ring 102 to the mill body 101. The ring 102 is sized to facilitate passage of the mill 100 through a tubular member and also to inhibit undesired abutment of the mill 100 on an edge or surface of a coupling bushing, e.g. as a system as in FIG. 1D is moved down through the coupling bushings 36. Upon contact of the ring 102 with a top of a coupling bushing, the pins 104 shear and the mill 100—which is now positioned of the top entry into the coupling bushing due to the position of the ring 102—easily enters the coupling bushing.

Figure 15B:
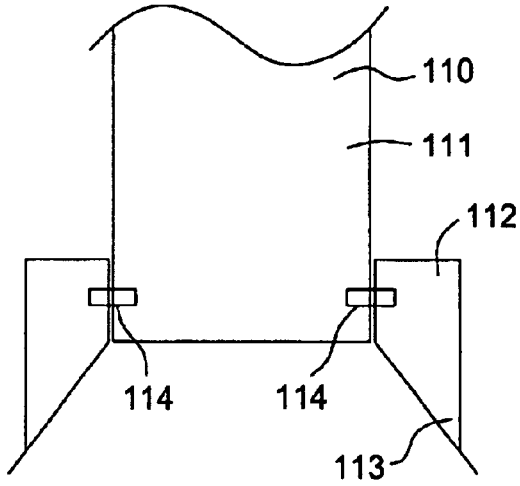

FIG. 15B shows a mill 110 usable as the mill in any system described herein which has a cylindrical mill body 111 to which is releasably secured a ring 112 that tapers from top to bottom with a taper 113. Shearable pins or bolts 114 releasably hold the ring 112 to the mill body 111. The ring 112 is sized to facilitate passage of the mill 110 through a tubular member and also to inhibit undesired abutment of the mill 110 on an edge or surface of a coupling bushing, e.g. as a system as in FIG. 1D is moved down through the coupling bushings 36. Upon contact of the ring 112 with a top of a coupling bushing, the pins 114 shear and the mill 110—which is now positioned at the top entry into the coupling bushing due to the position of the ring 112—easily enters the coupling bushing.

Figure 15C:
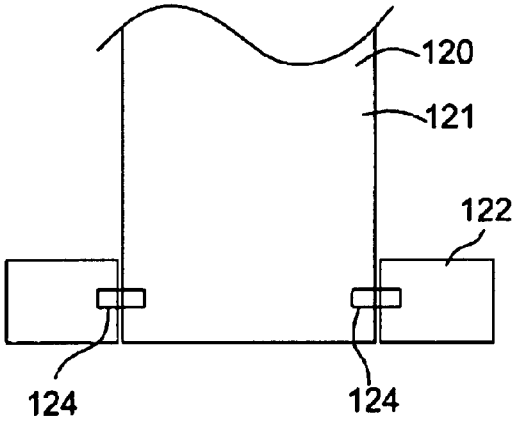

FIG. 15C shows a mill 120 usable as the mill in any system described herein which has a cylindrical mill body 121 to which is releasably secured a circular cylindrical ring 122. Shearable pins or bolts 124 releasably hold the ring 122 to the mill body 121. The ring 122 is sized to facilitate passage of the mill 120 through a tubular member and also to inhibit undesired abutment of the mill 120 on an edge or surface of a coupling bushing, e.g. as a system as in FIG. 1D is moved down through the coupling bushings 36. Upon contact of the ring 122 with a top of a coupling bushing, the pins 124 shear and the mill 120—which is now positioned of the top entry into the coupling bushing due to the position of the ring 122—easily enters the coupling bushing. In one aspect, the rings remain in the wellbore. In certain aspects, the rings are made of steel, brass, phenolic, composite, plastic, metal, or fiberglass.

As any of the mills shown in FIGS. 15A–15C move down into the coupling bushing and further downwardly, the rings 102, 112, and 122 remain atop a coupling bushing and the mill (and related tubulars) move through the ring.

In one aspect the rings are held with shear pins which shear in response to about 500 to 6000 pounds of force, and, in one aspect, about 4000 pounds of force. Shearing of a ring 102, 112, or 122 gives a positive indication at the surface of a precise location in the wellbore and, in certain aspects, a known location at a point above and near the area at which milling will commence.

The mills of FIGS. 15A–15D represent schematically any suitable known mill. Such a mill may be dressed with any known milling matrix material and/or milling inserts in any known array, pattern or configuration by any known application method.

The rings 102, 112, and 122 as shown completely encircle and encompass the cylindrical mill bodies with which they are associated. In certain embodiments acceptable centering of a mill is achieved by a partial ring (e.g. that encompasses about 180 degrees or about 270 degrees of the mill body's circumference) or by individual blocks whose cross-section appears like the cross-sections of the rings in FIGS. 15A–15C, but which are spaced apart around the mill body. In certain aspects two, three, four or more such blocks are used with a width, as viewed from above of between about one to about ten inches.

Figure 15D:
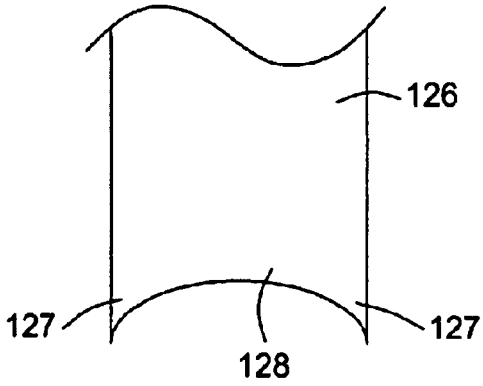

FIG. 15D shows a mill 126 with a cylindrical mill body 125 having a lower concave face 128 having relatively sharp corners 127. Any mill in FIGS. 15A–15D (and any mill disclosed herein) may be dressed with any known matrix milling material, rough or ground smooth; any known milling inserts in any known pattern, array, or combination; any combination thereof; and/or with milling inserts projecting out from and beyond matrix milling material.

Figure 16A:
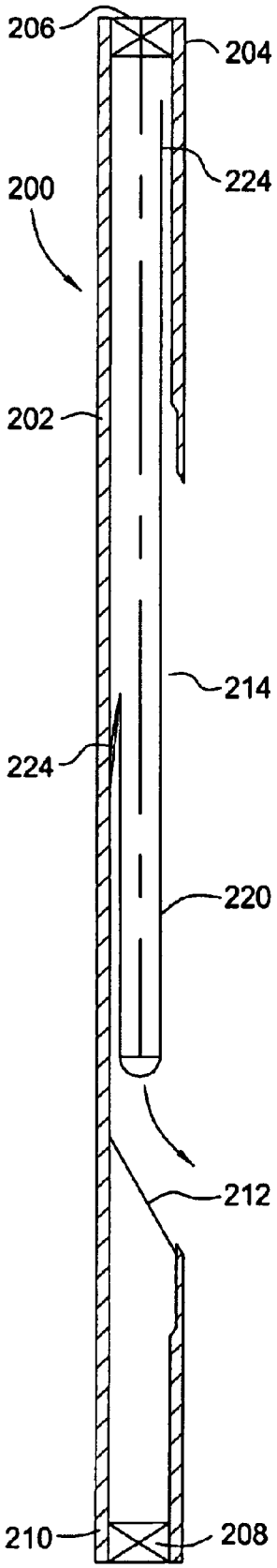
FIGS. 16A, 16B, and 16E are side cross-section views of a liner system according to the present invention.

FIG. 16A shows a system 200 with a tubular member 202 having a top end 204 with an anchor 206 and a bottom end 208 with a plug, (preferably drillable) 210. An anchor may be provided at the end 208. A bar, whipstock, or diverter 212 is secured at a lower end of a pre-formed or pre-machined window 214 to and within the tubular member 202.

A sleeve 220, e.g. a liner or wellbore tubular, (made e.g. of metal, brass, bronze, zinc, zinc alloy, aluminum, aluminum alloy, fiberglass, or composite) is releasably secured in or is inserted into and through the tubular member 202. The sleeve 220 is moved down to contact the diverter 212 which urges the sleeve 212 to a position as shown in FIG. 16B (e.g. into an already underreamed formation portion or into a lateral bore extending from a main wellbore).

Figure 16B:
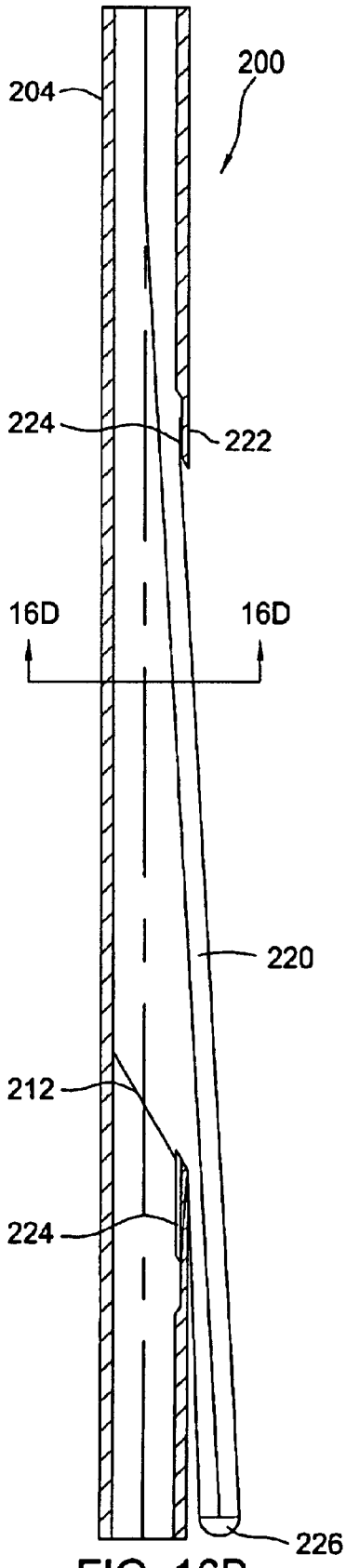
Figure 16C:
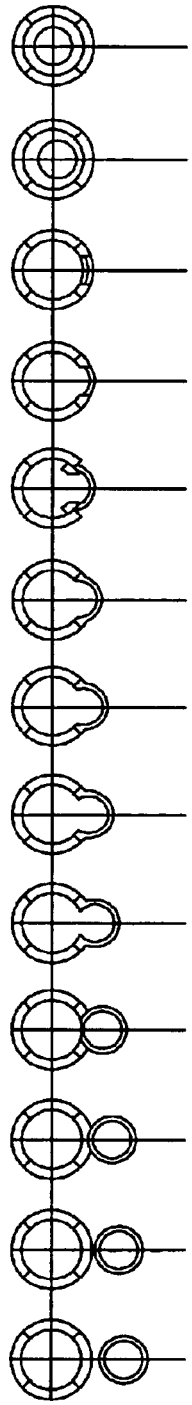
FIG. 16C shows cross-section views along the length of the system as illustrated in FIG. 16B.
Figure 16D:
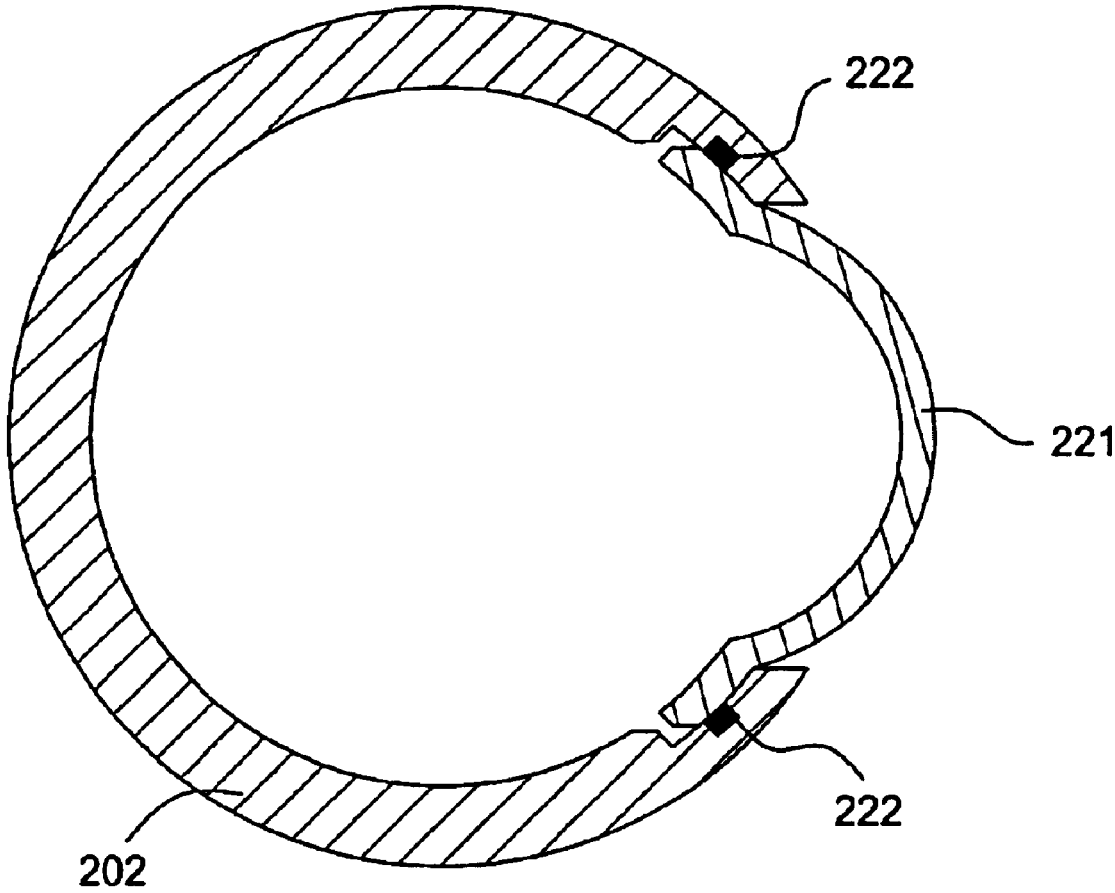
FIG. 16D is a cross-section view along line 16D—16D of FIG. 16B.

When the sleeve 220 is in the position shown in FIG. 16B an activatable sealing material 222 disposed around the edge of the window 214 is activated to effect sealing securement of the sleeve 220 at the window 214. Preferably a flange 224 formed of or secured to the sleeve 220 extends interiorly beyond the edge of the window 214 to facilitate sealing of the sleeve at the window and to serve as a stop and locking device.

Figure 16E:
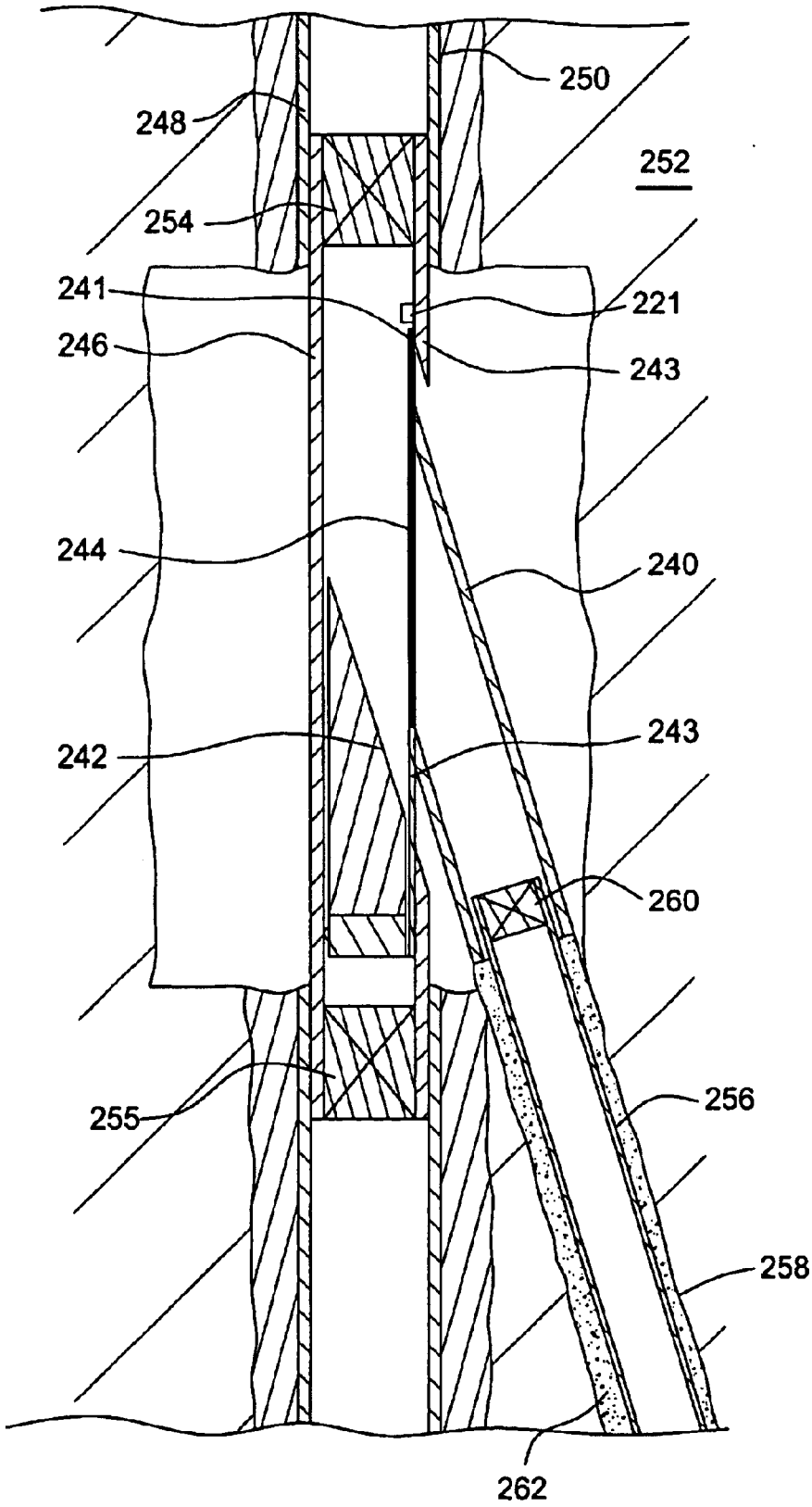

Any suitable stored energy medium may be used as the sealing material 222, including, but not limited to, thermite and other iron oxide-aluminum compounds which react to form a metal seal or weld between parts and which are activated by heat with suitable initiation devices as are well known in the art indicated schematically by the device 221, FIG. 16E.

In one aspect, not shown, the sleeve 220 has an open lower end. As shown in FIGS. 16A and 16B a pressure-containing drillable shoe or end cap 226 seals off the sleeve's bottom end.

In one aspect the diverter 212 is replaceable or removable in the wellbore or at the surface. The sleeve 220 may be any desired length.

As shown in FIG. 16E a sleeve 240 (like the sleeve 220) with a flange 241 has been installed at a pre-formed window 244 of a tubular body 246 installed in a casing 248 of a wellbore 250 extending from an earth surface down in an earth formation 252 and sealed in place with sealing material 243. A top anchor 254 anchors the top of the tubular body 246 in casing 248. A diverter 242 secured within the body 246 (removable or not) has urged the sleeve 240 into an underreamed part of the formation 252 and a liner 256 has been inserted into and through the sleeve 240. The liner 256 (any desired length) extends down into a lateral wellbore 258. A liner hanger or packoff liner hanger 260 is at the top of the liner 256. The liner may be cemented into place with cement 282. An anchor 255 anchors the bottom of the tubular body 246. Alternatively a plug may be used instead of, or in addition to, the anchor 255.

In one aspect a system with a sleeve as shown in FIG. 16A or 16E is run in a well and set, or bridged, across an already milled and under-reamed portion of casing. The sleeve is then pushed down to the diverter and forced out the pre-machined window in the tool body. In this position, the flange on the sleeve is adjacent to a shoulder in the pre-machined window and positioned in place. The stored energy medium reaction is then initiated creating a pressure-containing seal between the flange and the tool body. At this point, a lateral open hole may be drilled or an existing lateral open hole may be lengthened. An additional length of liner may be run into the drilled open hole and hung off the sleeve and then cemented into place.

Alternatively, the lateral open hole is first drilled and then an entire liner string with a flange on top (like, e.g. the flange 241, FIG. 16E) is run into place. A seal is then activated (as with the systems of FIGS. 16A and 16E with sealing material 222 or 243). If desired, the liner is then cemented in place.

In another embodiment, a system as in FIG. 16A or 16E is run into a new well (without a sleeve or liner in place within the tool body) by placing the tool body directly in a new casing string while running in hole, with slight modifications (e.g. no anchors or plugs are needed) to the tool body. The aforementioned procedures are then followed, with the absence of section milling and under-reaming.

Figure 16F:
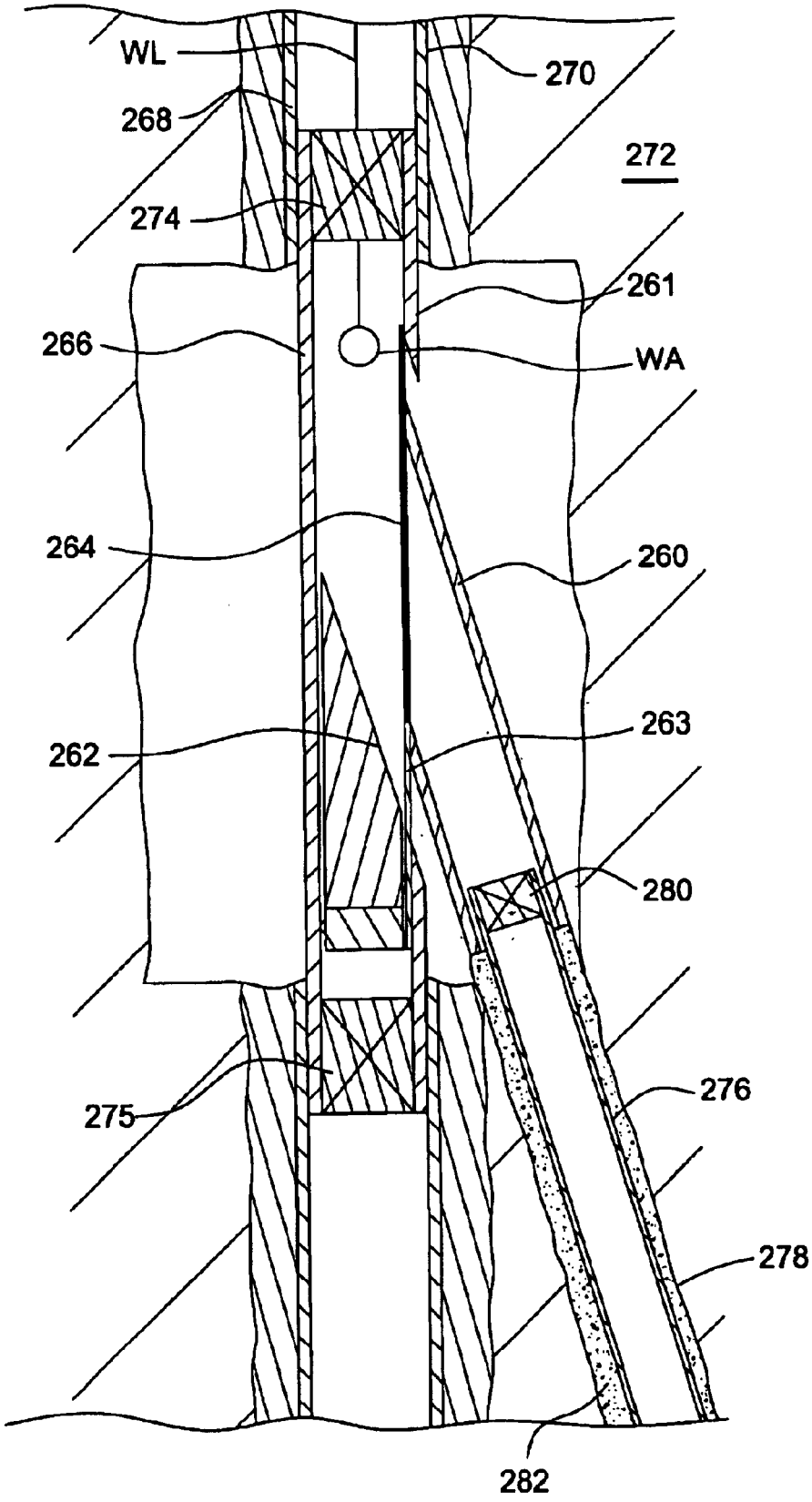
FIG. 16F is a side cross-section view of a system according to the present invention.

As shown in FIG. 16F a sleeve 260 (like the sleeves 220, 240) with a flange 261 has been installed at a pre-formed window 264 of a tubular body 266 installed in a casing 268 of a wellbore 270 extending from an earth surface down in an earth formation 272 and sealed in place with sealing material, as described above or, alternatively by welding with a welding apparatus WA which is used either before installation of a top anchor 274 or is movable through the top anchor 274 after it is installed. Any suitable known welding apparatus, machine or device may be used for the welding apparatus WA. In one embodiment the top anchor 274 anchors the top of the tubular body 266 in casing 268. A diverter 262 secured within the body 266 (removable or not) has urged the sleeve 260 into an underreamed part of the formation 272 and a liner 276 has been inserted into and through the sleeve 260. The liner 276 (any desired length) extends down into a lateral wellbore 278. A liner hanger or packoff liner hanger 280 is then installed at the top of the liner 276. The liner may be cemented into place with cement 282. An anchor 275 anchors the bottom of the tubular body 266. Alternatively a plug may be used instead of, or in addition to, the anchor 275. Alternatively, the welding apparatus may be run into the wellbore on new casing being installed in the wellbore. Optionally the diverter 262 is positioned outside the body 266 and/or below it, and/or below a bottom end of the sleeve 260.

In one aspect a system with a sleeve as shown in FIG. 16F is run in a well and set, or bridged, across an already milled and under-reamed portion of casing. The sleeve is then pushed down to the diverter and forced out the pre-machined window in the tool body. In this position, the flange on the sleeve is adjacent to a shoulder in the pre-machined window and positioned in place. The sleeve is then sealingly welded in place with the welding apparatus WA (which, e.g. is run in the hole on a wireline WL). Alternatively the welding apparatus WL may be run in the hole on coiled tubing, on a cable, on a rope, or any other suitable means. Optionally, a stored energy medium reaction is initiated creating a pressure-containing seal between the flange and the tool body. A lateral open hole may then be drilled or an existing lateral open hole may be lengthened. An additional length of liner may be run into the drilled open hole and hung off the sleeve and then cemented into place. Alternatively, the lateral open hole is first drilled and then an entire liner string with a flange on top is run into place. A seal is then made. If desired, the liner is then cemented in place.

In another embodiment, a system as in FIG. 16F is run into a new well (without a sleeve or liner in place within the tool body) by placing the tool body directly in a new casing string while running in hole, with slight modifications (e.g. no anchors or plugs are needed) to the tool body. The aforementioned procedures are then followed, with the absence of section milling and under-reaming.

The present invention, therefore provides in some, but not necessarily all, embodiments a wellbore apparatus with a tubular member with a top end, a bottom end, a hollow portion, and a window (optionally preformed) therethrough, a sleeve positioned within the hollow portion of the tubular member, the sleeve having a top end and a bottom end, a diverter apparatus, the sleeve movable so that the diverter, and the diverter directs the sleeve to the window and through the window into a bore extending beyond the window, and the window having an edge therearound to which the top end of the sleeve is weldable to sealingly secure the sleeve at the window. Such an apparatus may have one or some (in any possible combination) of the following: the sleeve having a flange for securement around the edge of the window; wherein the sleeve is welded to the edge of the window; wherein the sleeve is welded to the window's edge by a welding apparatus; and/or wherein the sleeve is welded to the window's edge by activating activatable sealing material disposed around the edge of the window.

The present invention, therefore provides in some, but not necessarily all, embodiments a wellbore apparatus with a tubular member with a top end, a bottom end, a hollow portion, and a window therethrough, a sleeve positioned within the hollow portion of the tubular member, the sleeve having a top end and a bottom end, a diverter, the sleeve movable so the bottom end thereof contacts the diverter, and the diverter directs the sleeve to the window and through the window into a bore extending beyond the window, the window having an edge therearound to which the top end of the sleeve is weldable to effect sealing securement of the sleeve at the window, wherein the sleeve is welded to the window's edge by a welding apparatus, and anchor apparatus for anchoring the tubular member in the bore.

The present invention, therefore provides in some, but not necessarily all, embodiments a method for installing a sleeve in an area extending from a main earth bore, the method including introducing a wellbore apparatus into the main earth bore adjacent an opening of an area extending from the main earth bore, the wellbore apparatus as any disclosed herein, moving the sleeve to co-act with the diverter, moving the sleeve into the lateral bore, and effecting a seal around the edge of the window by welding the top end of the sleeve to the edge of the window.

The present invention, therefore provides in some, but not necessarily all, embodiments a wellbore apparatus with a tubular member with a top end, a bottom end, a hollow portion, and a window therethrough, a sleeve positioned within the hollow portion of the tubular member, the sleeve having a top end and a bottom end, a diverter, the sleeve movable so the diverter directs the sleeve to the window and through the window into a bore extending beyond the window, and the window having an edge therearound and activatable sealing material disposed around the edge to effect sealing securement of the sleeve at the window, wherein the activatable sealing material is a stored energy medium, an initiation device for activating the stored energy medium, and anchor apparatus for anchoring the tubular member in a bore.

The present invention, therefore provides in some, but not necessarily all, embodiments a method for installing a sleeve in a lateral bore extending from a main bore, the method including introducing a wellbore apparatus with a window into the main bore so that the window is adjacent an opening of the lateral bore, the wellbore apparatus as any disclosed herein, moving the sleeve to co-act with the diverter, moving the sleeve into the lateral bore, and effecting a seal around the edge of the window by activating the activatable sealing material.

The present invention, therefore provides in some, but not necessarily all, embodiments a liner system for lining a bore, the liner system with a liner string, a top flange on the liner string for abutting an edge of a window in a tubular, and activatable sealing material on the flange for sealing the flange around the edge of the window.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A wellbore junction comprising:

a preformed portion of a lateral wellbore;

a first tubular member having an aperture formed in a wall thereof;

a diversion member disposed within the first tubular member; and a second tubular member coaxially disposed within the first tubular member, wherein the first tubular member, the second tubular member, and the diversion member are insertable into a wellbore in a single run, at least a portion of the second tubular member permanently disposable within the preformed portion of the lateral wellbore.

2. The wellbore junction of claim 1, wherein the second tubular member is slideably disposed within the first tubular member.

3. The wellbore junction of claim 1, wherein the diversion member has a tapered surface directed toward the aperture.

4. The wellbore junction of claim 1, wherein the diversion member guides the second tubular member toward the aperture such that at least a portion of the second tubular member extends beyond the aperture.

5. The wellbore junction of claim 1, wherein the first tubular member and the second tubular member are operatively coupled to limit the distance which the second tubular member may extend outside the aperture.

6. The wellbore junction of claim 1, wherein the second tubular member is a lateral liner member.

7. The wellbore junction of claim 1, wherein the diverter member guides the second tubular member from a first coaxial position within the first tubular member to a second divergent position through the aperture.

8. The wellbore junction of claim 1, further comprising a locating device to locate the second tubular member in an extended position relative to the first tubular member.

9. A method for creating a junction assembly proximate a junction between a main wellbore and a lateral branch bore comprising:

operatively coupling a first tubular member to a second tubular member, whereby the first tubular member is substantially coaxial with the second tubular member, thereby forming an assembly which is insertable into a wellbore, the second tubular member having an aperture formed in a wall thereof, and having a diverter member for cooperating with the first tubular member to guide at least a portion of the first tubular member through the aperture;

preforming the junction by forming at least a portion of the lateral branch bore from the main wellbore;

inserting the assembly within the main wellbore in a single run;

positioning the assembly proximate the junction;

guiding the first tubular member through the aperture; and permanently disposing at least a portion of the first tubular member in the lateral branch bore.

10. The method of claim 9, wherein the portion of the first tubular member extends outside of the second tubular member.

11. The method of claim 9, further comprising stopping the first tubular member at a predetermined point of extension.

12. The method of claim 9, further comprising anchoring the second tubular member in the main wellbore.

13. The method of claim 9, further comprising running a drilling member through the first tubular member.

14. The method of claim 9, wherein the first tubular member is a lateral liner.

15. A wellbore junction comprising:

a preformed lateral wellbore extending from a main wellbore;

a tubular member having an aperture formed in a wall thereof;

a diversion member disposed within the tubular member; and a lateral liner member coaxially disposed within the tubular member, wherein the tubular member, the lateral liner member, and the diversion member form an assembly that is insertable into the main wellbore in a single run, and the lateral liner member is permanently disposable within the lateral wellbore.

16. The wellbore junction of claim 15 wherein the diversion member guides the lateral liner member toward the aperture such that at least a portion of the lateral liner member extends beyond the aperture.

17. The wellbore junction of claim 15 wherein the tubular member and the lateral liner member are operatively coupled to limit the distance which the lateral liner member may extend outside the aperture.

18. The wellbore junction of claim 15, wherein the diverter member guides the lateral liner member from a first coaxial position within the tubular member to a second divergent position through the aperture.

19. A junction apparatus for installation proximate the intersection of a first wellbore and a lateral wellbore extending therefrom, comprising:

a first tubular member having an aperture formed in a wall thereof and a diversion member proximate the aperture; and a second tubular member operatively connected to the first tubular member, such that the first and second tubular members are substantially coaxial, wherein the first tubular member, the second tubular member, and the diversion member are insertable into a wellbore as an assembly, and wherein at least a portion of the second tubular member is extendable through the aperture and permanently locatable at an extended position within a preformed portion of the lateral wellbore.

20. The junction apparatus of claim 19, wherein the second tubular member is slideably disposed within the first tubular member.

21. The junction apparatus of claim 19, wherein the diversion member has a tapered surface directed toward the aperture.

22. The junction apparatus of claim 19, wherein the second tubular member is a lateral liner member.

23. The junction apparatus of claim 19, wherein the diverter member guides the second tubular member from a first coaxial position within the first tubular member to a second divergent position through the aperture.

24. The junction apparatus of claim 19, wherein the second tubular member is locatable with a locating member.

25. The junction apparatus of claim 24, wherein the locating member is a stop device.

26. A method for forming a wellbore junction structure proximate a junction between a first wellbore and a preformed portion of a lateral wellbore extending therefrom comprising:

operatively connecting a first tubular member having an aperture in a wall thereof and a diversion member proximate the aperture, and a second tubular member, thereby forming an assembly wherein the first and second tubular members are substantially coaxial;

moving the assembly in the first wellbore to a location proximate the junction;

extending the second tubular member through the aperture; and locating at least a portion of the second tubular member in an extended position into the preformed portion of the lateral wellbore, thereby forming a wellbore junction structure.

27. The method of claim 26, wherein extending the second tubular comprises diverting the second tubular with the diversion member.

28. The method of claim 26, further comprising stopping the second tubular member at a predetermined point of extension.

29. The method of claim 26, further comprising anchoring the first tubular member in the main wellbore.

30. The method of claim 26, wherein locating the second tubular member comprises abutting a locating member.

31. The method of claim 30, wherein the locating member is a stop device.

32. The method of claim 29, further comprising permanently disposing the second tubular member in the preformed portion of the lateral wellbore.

33. A method for forming a wellbore junction structure proximate a junction between a first wellbore and a lateral wellbore extending therefrom comprising:

operatively connecting a first tubular member having an aperture in a wall thereof and a diversion member proximate the aperture, and a second tubular member, thereby forming an assembly wherein the first and second tubular members are substantially coaxial;

moving the assembly in the first wellbore to a location proximate the junction; extending the second tubular member through the aperture;

locating the second tubular member in an extended position thereby forming a wellbore junction structure; and running a drilling member through the second tubular member.

34. A wellbore junction comprising:

a first tubular member having an aperture formed in a wall thereof;

a diversion member disposed within the first tubular member; and a second tubular member substantially coaxially disposed within the first tubular member, wherein the first tubular member, the second tubular member, and the diversion member are insertable into a wellbore in a single run, and wherein the second tubular member is permanently disposable within a lateral wellbore.

35. A wellbore junction comprising:

a first tubular member having an aperture formed in a wall thereof;

a diversion member disposed within the first tubular member; and a second tubular member substantially coaxially disposed within the first tubular member, wherein the first tubular member, the second tubular member, and the diversion member are insertable into a wellbore in a single run, and wherein the second tubular member is extendable into a lateral wellbore, at least a portion of the lateral wellbore preformed prior to inserting the first tubular member, second tubular member, and diversion member into the wellbore.

36. A method for creating a junction assembly proximate a junction between a main wellbore and a lateral branch bore comprising:

operatively coupling a first tubular member to a second tubular member, thereby forming an assembly which is insertable into a wellbore, wherein the first and second tubular member are substantially coaxial, the second tubular member having an aperture formed in a wall thereof, and having a diverter member for cooperating with the first tubular member to guide at least a portion of the first tubular member through the aperture;

inserting the assembly within the main wellbore in a single run;

positioning the assembly proximate the junction;

guiding the first tubular member through the aperture; and running a drilling member through the first tubular member.

37. A method for creating a junction assembly proximate a junction between a main wellbore and a lateral wellbore, comprising:

providing an assembly having a first tubular member operatively connected to a second tubular member, whereby the first tubular member is substantially coaxial with the second tubular member, the second tubular member having an aperture in a wall thereof;

inserting the assembly within the main wellbore in a single run;

positioning the assembly proximate the junction;

extending at least a portion of the first tubular member into the lateral wellbore; and permanently disposing the first tubular member within the lateral wellbore.

38. The method of claim 37, wherein prior to inserting the assembly within the main wellbore in a single run, at least a portion of the lateral wellbore is formed.

* * * * *

UNITED STATES PATENT AND TRADEMARK OFFICE

CERTIFICATE OF CORRECTION

PATENT NO. : 6,766,859 B2
DATED : July 27, 2004
INVENTOR(S) : Haugen et al.

It is certified that error appears in the above-identified patent and that said Letters Patent is hereby corrected as shown below:

Title page,
Item [75], Inventors, please correct "Mark Kuck" to read -- Marc Kuck --.

Column 15,
Line 25, please replace "29" with -- 26--.

Signed and Sealed this

Twelfth Day of April, 2005

JON W. DUDAS
*Director of the United States Patent and Trademark Office*